United States Patent [19]

Ruzicka

[11] 4,133,154

[45] Jan. 9, 1979

[54] SYSTEM FOR SUPPORTING REMOVABLE POSTS

[76] Inventor: Otto J. Ruzicka, 261 Iris Way, Palo Alto, Calif. 94303

[21] Appl. No.: 838,747

[22] Filed: Oct. 3, 1977

[51] Int. Cl.[2] ..... E02D 27/42

[52] U.S. Cl. ..... 52/298; 52/100; 52/704; 52/707

[58] Field of Search ..... 52/127, 298, 296, 297, 52/98, 99, 704, 706, 707, 100; 254/104; 403/377, 374, 409, 370; 248/354 R, 355, 412, 413

[56] References Cited

U.S. PATENT DOCUMENTS

| | | | |
|---|---|---|---|
| 2,210,441 | 8/1940 | Bachman | 52/297 |
| 2,753,602 | 7/1956 | Ringle | 52/98 |
| 2,784,015 | 3/1957 | Swanson | 52/298 X |
| 2,954,638 | 10/1960 | Motter | 52/298 X |
| 3,274,744 | 9/1966 | Blum et al. | 52/704 |
| 3,282,001 | 11/1966 | Bigalow | 52/298 X |
| 3,343,321 | 9/1967 | Axelsson | 52/296 |
| 3,467,416 | 9/1969 | Gourley | 403/377 |
| 3,579,936 | 5/1971 | Anderson | 52/297 |
| 3,653,169 | 4/1972 | Jenner et al. | 52/296 X |
| 3,698,144 | 10/1972 | Stratton | 52/99 |
| 3,815,304 | 6/1974 | Schille et al. | 52/100 |
| 3,894,375 | 7/1975 | Lindberg, Jr. | 52/298 |
| 3,957,381 | 5/1976 | Schafer | 403/374 X |
| 3,998,870 | 11/1976 | Snavely | 52/297 X |
| 4,059,934 | 11/1977 | Hayamizu | 52/297 |

FOREIGN PATENT DOCUMENTS

| | | | |
|---|---|---|---|
| 2123442 | 11/1972 | Fed. Rep. of Germany | 52/296 |
| 2823 | 12/1918 | Netherlands | 52/298 |
| 191231 | 9/1964 | Sweden | 52/296 |

*Primary Examiner*—Leslie Braun
*Attorney, Agent, or Firm*—Stephen P. Fox

[57] ABSTRACT

An elongated tapered enclosure tightly receives a collar attached to the bottom of a post. A plurality of adjustable wedges at the top of the enclosure engage the post and serve to plumb the post and firmly secure it in the enclosure. The enclosure is set in the ground flush with the ground surface. Posts are easily inserted into and removed from the enclosure to provide portable members for supporting traffic signs, walls, partitions, roofs and the like.

4 Claims, 5 Drawing Figures

SYSTEM FOR SUPPORTING REMOVABLE POSTS

BACKGROUND AND SUMMARY OF THE INVENTION

To facilitate replacement of traffic sign posts and the like that are frequently broken away from their moorings due to the impact of vehicles or the effect of heavy winds, etc., many such posts have been designed with "break-away", "easy-to-replace" features. One such post is described, for example, in U.S. Pat. No. 3,355,998 entitled "Highway Marker Device" issued Dec. 5, 1967 to A. V. Roemisch. Such breakaway posts have found use in the replacement of traffic signs and the like; however, they require specially manufactured upper and lower post portions which are not compatible with many posts now in use. In addition, heretofore known breakaway posts are generally unsuitable for supporting heavy items such as partitions, walls and roofs in temporary locations. What is needed, therefore, is a supporting device which can be easily replaced if broken upon impact, if desired, as well as a device that will firmly support partitions, walls and the like, and enable such structures to be easily relocatable.

Accordingly, the present invention provides a support system for housing removable posts upon which traffic signs, partitions, walls, roofs, etc., may be removably affixed. The support system comprises an enclosure that is placeable below ground or in the floor of a building. The enclosure is disposed for receiving a post removably inserted and extending above ground, upon which signs, partitions, walls, or the like may be affixed. The lower portion of the enclosure is tapered to a decreased cross-section and dimensioned to firmly bind a collar mounted on the bottom end of the post. The upper end of the post is firmly secured by wedges between the post and the enclosure. Adjustment of the wedges serves to plumb the post. Posts having different cross-sectional configurations may be secured in the enclosure by modifying the configuration of internal aperture of the collar affixed to the bottom of the post.

DESCRIPTION OF THE PREFERRED EMBODIMENT

Figure 1:
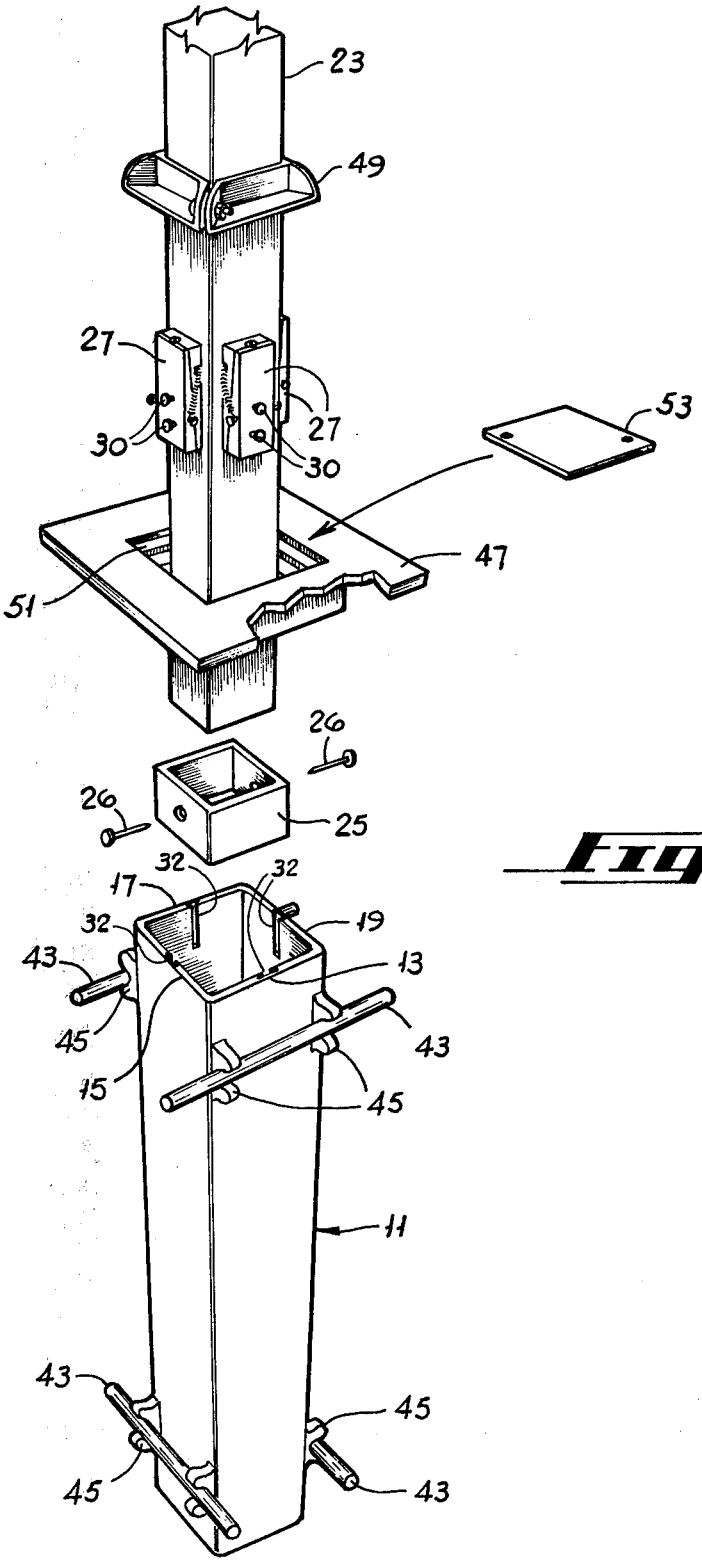
FIG. 1 is an exploded perspective view of one embodiment of the support system of the present invention.
Figure 2:
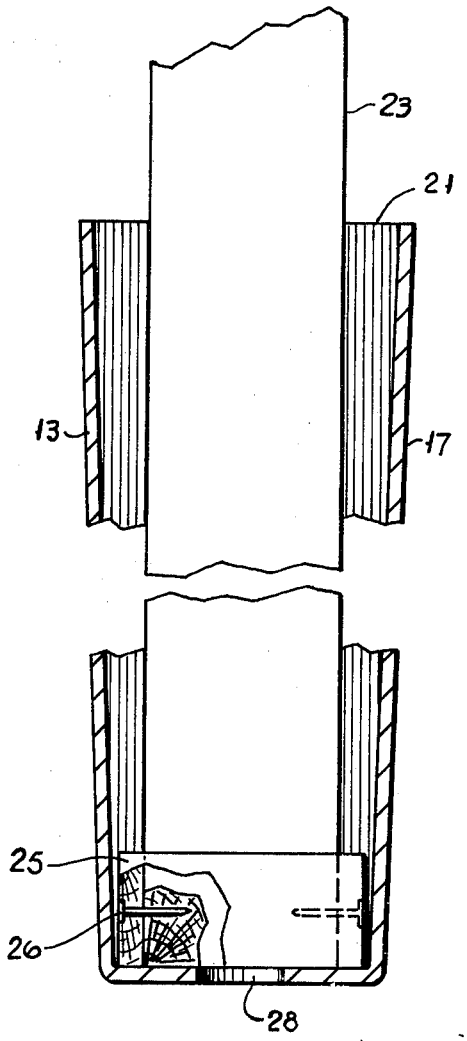
FIG. 2 is a diagrammatic side-sectional view of an assembled portion of the embodiment shown in FIG. 1.

Referring now to FIGS. 1 and 2 of the drawings, there is shown an enclosure 11 having a core portion with four sides 13, 15, 17, 19, forming a tapered core 21 in which a post 23 may be placed, and later removed. The tapered core 21 is formed by tapering the inside surfaces of sides 13, 15, 17, 19, from top to bottom, so that the bottom horizontal cross-section of core 21 is smaller than the top cross-section. Removably secured to the bottom of post 23 is a collar 25. Screws or other suitable fastening means 26 are used to firmly attach the collar 25 to the post. The post 23 with attached collar 25 is inserted into core 21 until collar 25 is firmly wedged into the tapered lower portion of the core, thereby to prevent movement of the lower portion of the post. The bottom of enclosure 11 includes a removable or knock-out portion 28 for accessing the interior of the enclosure and the post (if hollow) with electrical wires.

The cross-sectional configuration of post 23 may be rectangular, as shown in the figures, or of some other configuration such as round or hexagonal. Collar 25 which surrounds the bottom of the post is suitably configured to accommodate and tightly attach to the particular type of post used.

The portion of post 23 located at the top of the core is secured against the sides 13, 15, 17, 19, of the enclosure 11 by means of wedges 27 described in more detail hereinafter. Each wedge 27 includes a pair of rivets 30 which slide into corresponding slots 32 in the sides of enclosure 11. The wedge is placed between one side of post 23 and the inside surface of one side of enclosure 11 located toward the top portion of core 21. The engagement of rivets 30 and corresponding slots 32 holds the wedges in place while the post is being inserted in the enclosure. The number of wedges used depends on the configuration of the post.

Figure 3:
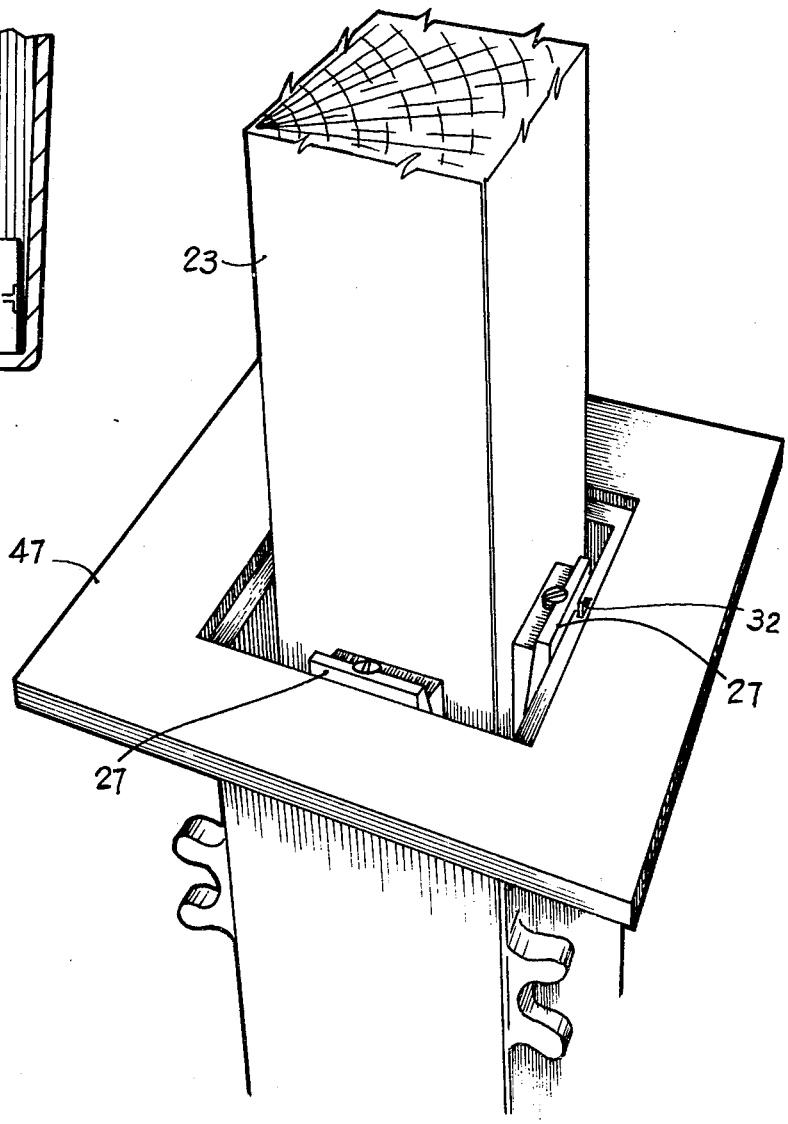
FIG. 3 is an enlarged perspective view of an assembled portion of FIG. 1.
Figure 4:
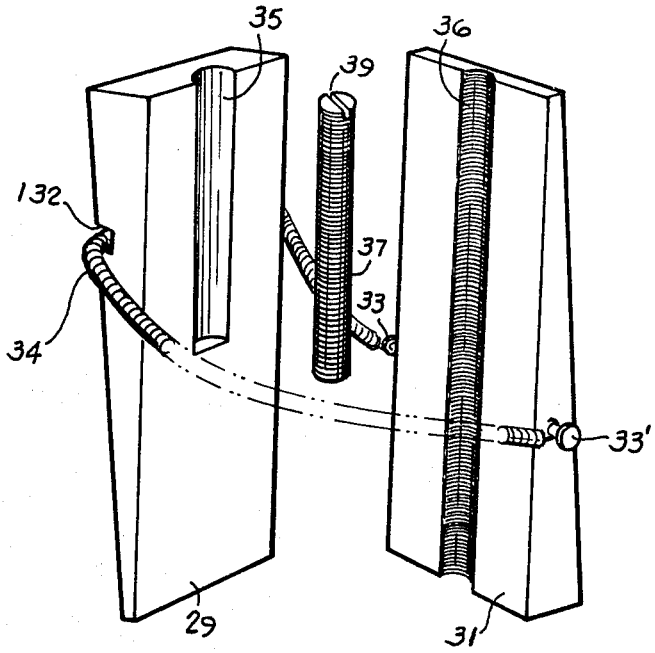
FIG. 4 is a perspective view of one of the wedge support members shown in FIG. 1.

As shown in FIGS. 3 and 4, each wedge 27 comprises a pair of tapered mating portions 29, 31. Portion 29 has an outside groove 132, while portion 31 secures two rivets 33, 33'. A spring 34 is disposed in slot 132. One end of spring 34 is attached to rivet 33 and the other end is attached to rivet 33' to hold the two mating portions 29, 31 tightly together. In additon, wedge portion 29 has a longitudinal groove 35 extending approximately one-half its length, a portion 31 has a longitudinal groove 36 which extends the length thereof and is internally threaded. Grooves 35, 36 are disposed for receiving a threaded rod 37 when portions 29, 31 are mated. Rod 37 has an end slot 39 therein for receiving a screwdriver (not shown) to turn the rod.

When rod 37 is turned in a clockwise direction, the rod limits against the bottom of groove 35 and wedge portion 31 advances upward relative to portion 29, thereby increasing the thickness of the wedge 27, and when rod 37 is turned in a counter-clockwise direction, wedge portion 31 moves relative to portion 29, thereby decreasing the thickness of the wedge 27. By rotating the rods to vary the thickness of each wedge, post 23 is moved laterally relative to the sides of enclosure 11, thereby plumbing the post. The spring 34 wrapped in groove 32 and encircling wedge portions 29 and 31 serves to keep the wedge portions together and to effectuate movement of said wedge portions relative to each other when threaded rod 37 is turned.

Preferably, the enclosure 11 including the four sides 13, 15, 17, 19, is molded in one piece from a suitable high-strength plastic. The enclosure may be of desired cross-sectional and length dimensions selected for the particular post being used.

Figure 5:
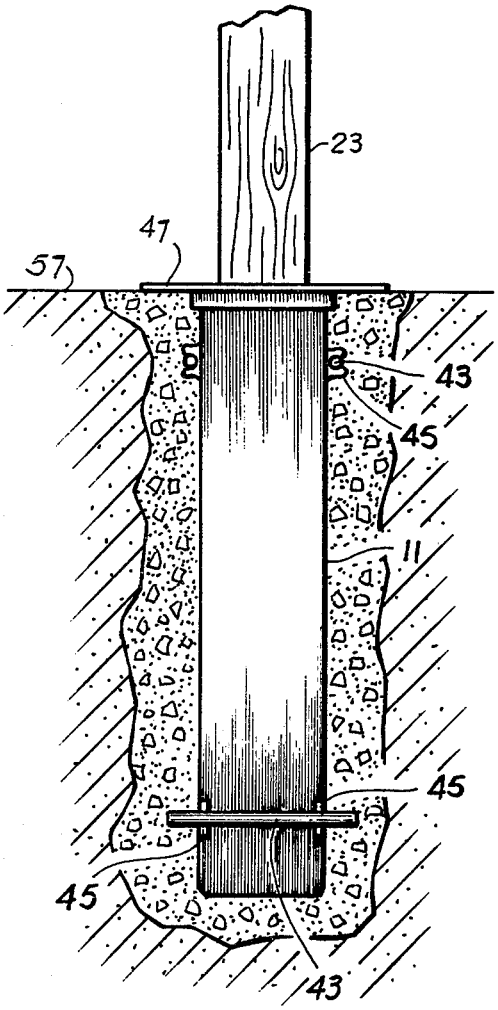
FIG. 5 is a side view of the post support system in situ.

With reference to FIG. 5, enclosure 11 is permanently placed in a suitable supporting environment. For example, the enclosure 11 may be placed in a hole in the ground and there surrounded with soft concrete which is thereafter allowed to harden. Also, enclosure 11 may be placed in the floor of a building. Steel rods 43, inserted into clips 45 disposed on sides 13, 15, 17, 19, (FIGS. 1 and 5) serve to anchor the core portion 11 into the ground or concrete.

As shown in FIGS. 1, 3, and 5, a flange 47 is placed over the top end of enclosure 11 to keep the top end flush or in line with the surface 57 of the ground or floor into which the enclosure is placed. After a post 23 is inserted into enclosure 11 and firmly set into the tapered base portion, the rivets 30 of a wedge 27 are inserted into mating slots 32 at the upper end of the core 21 between each side of the post 23 and the adjacent side of the enclosure. The wedges 27 are set below the top surface of flange 47 and tightened to plumb the post. Thereafter, a collar 49 is placed about the post 23 and immediately above the flange 47 in order to prevent dirt or other debris from entering the core by way of aperture 51. When no post is inserted into enclosure 11, a cover plate 53 may be used to cover aperture 51.

Enclosure 11 may be placed in various locations in the ground or in floors, and covered with plate 53 until needed. Thereafter, the plate 53 may be removed and a post 23 inserted, upon which post a structure such as a sign, a partition, a wall or a roof may be built. Such inserted posts and the structures erected thereon may later be relocated by removing the posts from their enclosures, placing new posts in previously unused enclosures, and building new partitions or walls on the newly relocated posts. Additionally, in the case where a post is used to support a traffic sign, posts broken by the impact of vehicles may be easily replaced by removing the broken post from the core and substituting a new sign post.

I claim:

1. A system for supporting a post having any one of a plurality of cross-sectional configurations, the system comprising:

an elongated enclosure having an upper open end and decreasing internal lateral dimensions along the length thereof from said open end;

a post support collar attachable by fasteners to a lower end portion of said post and fully insertable into said enclosure through said open end, said collar being dimensioned to tightly engage the lower interior walls of said enclosure at a position along the length thereof;

a plurality of wedges engaging said post at selected locations about the periphery of the post and engaging the internal walls of said enclosure at the open end of said enclosure, said wedges being selectively movable to adjust the position of said post relative to the walls of said enclosure;

at least two of said pluality of wedges each including two complementary mating portions movable relative to one another to change the external lateral dimension of the wedge;

one of said two complementary mating portions including a threaded longitudinal groove and the other of said complementary mating portions including a longitudinal unthreaded groove, said threaded and unthreaded grooves mating with one another to form a longitudinal bore internally of said wedge; and a threaded rod disposed in said bore, said rod being rotatable to move the complementary mating portions of said wedge relative to one another, thereby to change the external lateral dimension of said wedge.

2. The system of claim 1 wherein said rod has a slotted end extending from said wedge for receiving a screwdriver blade.

3. The system of claim 1 further including a spring attached to one complementary mating portion of said wedge and encompassing the other complementary portion of said wedge, thereby to maintain said complementary portions in engagement with one another.

4. The system of claim 1 further including slots in the internal walls of said enclosure at said open end thereof and protrusions affixed to said wedges for slidably engaging said slots.

* * * * *